US008327925B2

(12) United States Patent
King

(10) Patent No.: US 8,327,925 B2
(45) Date of Patent: Dec. 11, 2012

(54) USE OF BARITE AND CARBON FIBERS IN PERFORATING DEVICES

(75) Inventor: Allan W. King, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 378 days.

(21) Appl. No.: 12/332,834

(22) Filed: Dec. 11, 2008

(65) Prior Publication Data

US 2010/0147504 A1 Jun. 17, 2010

(51) Int. Cl.
*E21B 43/116* (2006.01)

(52) U.S. Cl. ..... 166/55.2; 102/476

(58) Field of Classification Search ..... 166/55, 166/55.2, 297; 264/319, 327; 102/476; 523/400, 523/435, 457
See application file for complete search history.

(56) References Cited

U.S. PATENT DOCUMENTS

| | | | | |
|---|---|---|---|---|
| 3,204,917 | A | 9/1965 | Richards | |
| 3,657,592 | A | 4/1972 | Kellar | |
| 4,338,713 | A * | 7/1982 | Christopher | 419/11 |
| 4,486,641 | A | 12/1984 | Ruffini | |
| 4,855,339 | A | 8/1989 | Saito | |
| 5,098,487 | A * | 3/1992 | Brauer et al. | 148/432 |
| 5,739,184 | A | 4/1998 | Marbry et al. | |
| 5,792,402 | A | 8/1998 | Rivers et al. | |
| 6,008,281 | A | 12/1999 | Yang et al. | |
| 6,048,379 | A | 4/2000 | Bray et al. | |
| 6,371,219 | B1 * | 4/2002 | Collins et al. | 175/2 |
| 6,898,908 | B2 | 5/2005 | Messenger et al. | |
| 6,998,434 | B2 | 2/2006 | Wadahara et al. | |
| 7,074,254 | B2 | 7/2006 | Fujisawa et al. | |
| 7,100,336 | B2 | 9/2006 | Messenger et al. | |
| 7,384,446 | B2 | 6/2008 | Unami et al. | |
| 7,410,603 | B2 | 8/2008 | Noguchi et al. | |
| 7,581,498 | B2 * | 9/2009 | Hetz et al. | 102/306 |

FOREIGN PATENT DOCUMENTS

| | | |
|---|---|---|
| WO | 2006054081 | 5/2006 |
| WO | WO 2006054081 A1 * | 5/2006 |

OTHER PUBLICATIONS

U.S. Appl. No. 12/326617, filed Dec. 2, 2008, inventor Allan W. King.
U.S. Appl. No. 12/330,619, filed Dec. 9, 2008, inventor Allan W. King.

* cited by examiner

*Primary Examiner* — Daniel P Stephenson
(74) *Attorney, Agent, or Firm* — Chad Sullivan; Rodney Warfford; Jody Lynn DeStefanis

(57) ABSTRACT

Disclosed are compositions that comprise mixtures of barite and carbon fiber material and further may include steel and a binder. The compositions may be utilized for manufacturing perforator devices, including perforating guns.

18 Claims, 3 Drawing Sheets

USE OF BARITE AND CARBON FIBERS IN PERFORATING DEVICES

BACKGROUND

The present specification relates generally to compositions that include barite and carbon fibers and the use thereof in perforating devices.

Perforating devices are often used to generate one or more perforations through a well casing in oil and natural gas wells. Typically, a perforating device having an array of explosive-charged perforators is lowered downhole into the well in a perforating gun. The perforating gun typically includes a closed metal cylinder that protects the perforators prior to firing. When the gun is at the correct depth in the well, the perforators are fired, sending shaped charge jets outward through the side of the gun, through the fluid between the gun and the well casing, through the well casing, and finally into the oil-bearing or natural-gas bearing rock. The resulting holes in the well casing allow oil or natural gas to flow into the well and to the surface. The remains of the perforating device, including the gun, must then be withdrawn from the well after the perforators have been fired.

SUMMARY

Disclosed are compositions that include a mixture of barite and carbon fibers and the use thereof for manufacturing perforating devices, including perforating guns, for use in generating one or more perforations through a well casing. In some embodiments, the perforating gun is configured to hold one or more shaped charges and comprises the mixture of barite and carbon fibers.

The perforating gun comprises a mixture of barite and carbon fibers. Optionally, the mixture further may include metal or steel (i.e., an alloy comprising mostly iron and having a carbon content of between 0.2% and 2.04% by weight, depending on grade).

Barite may include barite powder and the optional metal or steel may include metal powder or steel powder. In some embodiments, the perforating gun is formed from barite powder and (optionally metal or steel powder) that is mixed with a binder, which also may be a powder. Suitable binders include polymeric materials or waxes. The binder may be a curable binder such as a curable epoxy powder or thermosetting epoxy resin. In further embodiments, the binder may be flash-cured or sintered.

In some embodiments, the perforating gun includes at least about 25% of the mixture of barite and carbon fibers, with the remainder of the perforating gun being steel and a binder. In further embodiments, the perforating gun includes at least about 30% of the mixture of barite and carbon fibers, with the remainder of the component being steel and a binder.

Preferably, the perforating gun has a density that is suitable for use in a perforating device. In some embodiments, the component has a density within the range of about 3.0-7.5 grams/cc.

Also disclosed are methods for making perforating devices for use in completing a well or components of perforating devices. The methods may include forming a perforating gun out of a mixture comprising barite and carbon fibers, the perforating gun configured to hold one or more shaped charges. Optionally, the material may further include metal or steel (e.g., metal powder or steel powder) and a binder (e.g., a binder powder). Preferably, the material includes at least about 25% of the mixture of barite and carbon fibers, with the remainder being steel and a binder, and the material has a density in the range of about 3.0-7.5 grams/cc.

The perforating gun may be formed by pressing a mixture of barite and carbon fibers (and optionally metal and a binder) into a forming mold and heating the mixture (e.g., to a temperature of about 300-400° F.) in the mold. Subsequently, the pressed and heated mixture may be cooled to room temperature and removed from the mold to provide the perforating gun. The perforating gun, which typically has a hollow shape (e.g., hollow cylindrical) may be laminated with one or more layers on the interior surface or the exterior surface of the gun (e.g., fiberglass material or carbon fiber cloth). In some embodiments, the interior or the exterior surface of the perforating gun is laminated with steel (e.g., thin-walled steel) or plastic (e.g., plastic pipe).

Also disclosed are barite and carbon fiber compositions. The compositions may include (a) barite (e.g., barite powder); (b) carbon fiber; optionally (e) metal or steel (e.g., metal powder or steel powder); and optionally (d) a binder (e.g., a binder powder). Preferably, the composition has a density within a range of 3.0-7.5 grams/cc. In some embodiments, the composition includes at least about 25% of a mixture of barite and carbon fiber (w/w) (or at least about 30% of a mixture of barite and carbon fiber (w/w)). The remainder of the composition may include metal (or steel) and binder (e.g., an epoxy powder, an epoxide resin, a polymeric material, or a wax). The composition may be utilized for forming one or more components of a perforating device (e.g., a perforating gun).

BRIEF DESCRIPTION OF THE DRAWINGS

The best mode of carrying out the invention is described with reference to the following drawing figures.

DETAILED DESCRIPTION

Figure 1:
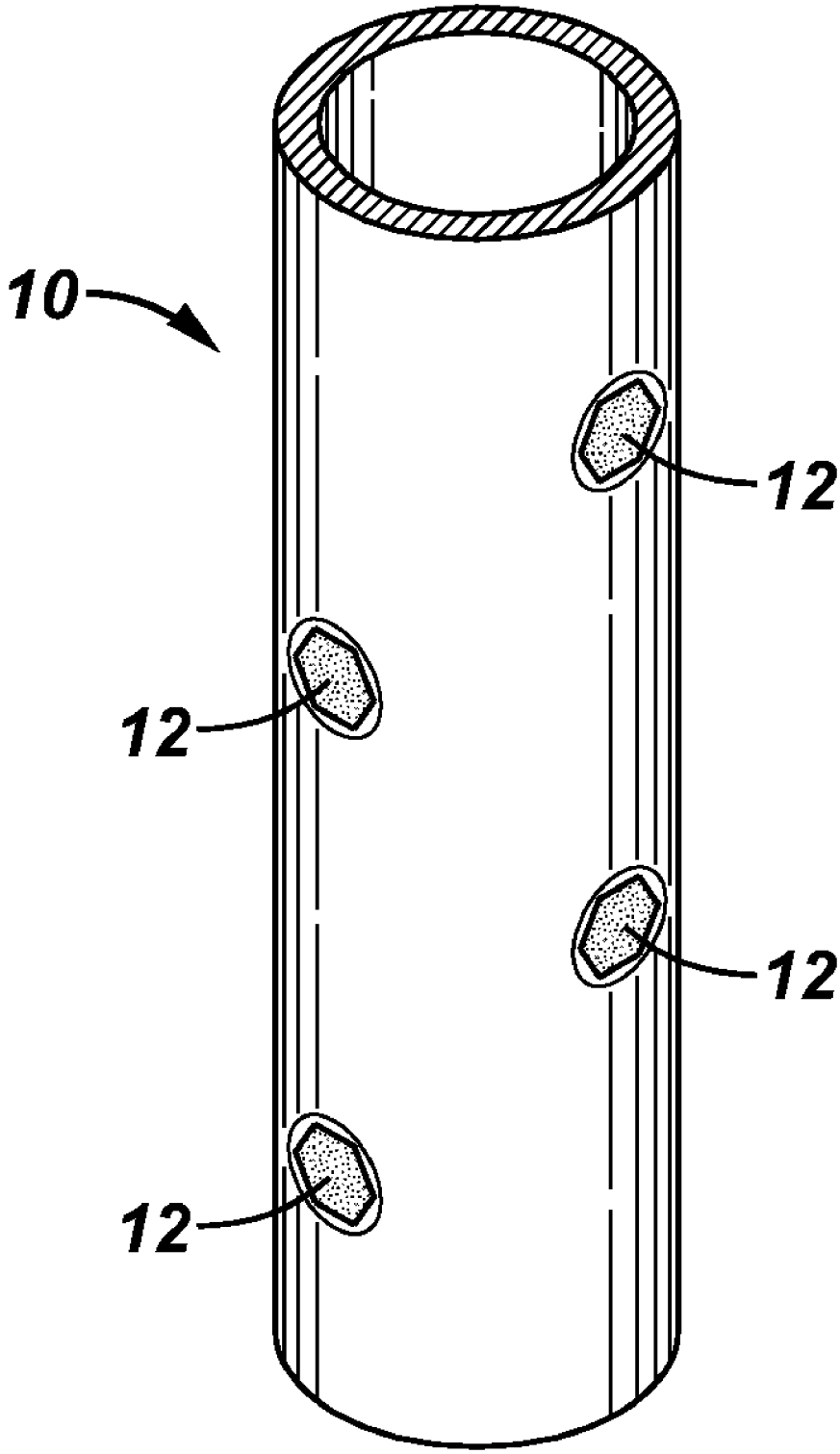
FIG. 1 is a perspective view of a perforating gun.

The disclosed subject matter is further described below.

Unless otherwise specified or indicated by context, the terms "a", "an", and "the" mean "one or more."

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≦10% of the particular term and "substantially" and "significantly" will mean plus or minus >10% of the particular term.

As used herein, the terms "include" and "including" have the same meaning as the terms "comprise" and "comprising."

Barite, otherwise called "baryte" or "$BaSO_4$" is the mineral barium sulfate. It generally is white or colorless and is a source of barium. It has a Moh hardness of about 3, a refractive index of about 1.63, and a specific gravity of about 4.3-5.0. Barite may be ground to a small, uniform size (i.e., barite powder) and may be used as a filler or extender in industrial products, or as a weighting agent in petroleum well drilling mud.

Carbon fiber may be alternatively referred to as graphite or graphite fiber. Carbon fiber contains mainly carbon atoms (preferably at least about 90% carbon) bonded together in elongated microscopic crystals. The preferred average length for the carbon fibers of the present composition is about ⅛ inch, which carbon fibers may be mixed with barite and powdered steel. Carbon fiber has a tensile strength of about 3.5 GPa, a tensile modulus of about 230.0 GPa, a density of about 1.75 g/ccm, and a specific strength of about 2.00 Gpa.

Steel, is a mixture or alloy that includes mainly iron, with a carbon content between 0.2% and 2.04% by weight, depending on grade. Carbon is the most cost-effective alloying material for iron, but various other alloying or nodularizing elements may be used such as manganese, chromium, vanadium, tungsten, tin, copper, lead, silicon, nickel, magnesium.

As disclosed herein, materials comprising barite and carbon fibers have been identified as a substitute material for steel which is utilized for manufacturing perforator devices used in oil and gas bearing formations. These perforator devices in which barite is used as a replacement material include perforating guns and associated components. Barite has a density that is about ⅔ that of steel. Surprisingly, this reduction in density was not observed to materially affect the perforator's performance.

The perforator guns disclosed herein comprise a mixture of barite and carbon fiber. In some embodiments, the perforator guns comprise at least about 25%, 30%, 40%, 45%, of 50% (w/w) of the mixture of barite and carbon fiber. The remainder optionally may comprise a binder (e.g., at least about 1%, 2%, 5%, 10%, or 20% (w/w)). The remainder may comprise a metal or metal alloy such as steel (e.g., at least about 20%, 25%, 30%, 35%, 40%, 45%, 50%, 55%, 60%, 65%, 70%, or 75% (w/w)). The barite, binder, metal (or metal alloy) may be in the form of a powder which is subsequently heat-treated or otherwise cured together with the carbon fibers.

Powder metallurgy and the use of powdered materials and binders for forming shaped articles are known in the art. (See, e.g., U.S. Pat. No. 6,048,379, which is incorporated by reference in its entirety.) Perforating guns can be prepared by forming a mixture comprising barite (e.g., barite powder), carbon fibers, metal or steel (e.g., metal powder or steel powder), and a binder. Suitable binders will hold together particles of the barite powder and particles of the metal or steel powder. Suitable barite for use in the shaped components disclosed herein may include glassmaker barite. Suitable barite products also are available from Mi-Swaco Corporation.

Carbon fibers and the use thereof to form carbon-fiber metal composites and carbon fiber reinforced compositions are known in the art. (See, e.g., U.S. Pat. Nos. 7,410,603; 7,100,336; 6,998,434; 6,898,908; 5,792,402.) As contemplated herein, a perforator gun may be prepared by pressing a mixture comprising barite, carbon fibers, steel, and a binder into a mold to form the shaped perforator gun in green form. The perforator gun then may be heated to a sufficient temperature for flash-curing. Subsequently, the perforator gun may be cooled to room temperature and assembled with a plurality of shaped charges. The perforating gun, which typically has a hollow shape (such as a hollow cylindrical shape) may be laminated with one or more layers on the interior surface or the exterior surface of the gun. Suitable materials for laminating the interior surface or the exterior surface include fiberglass material or carbon fiber cloth material. In some embodiments, the interior or the exterior surface of the perforating gun may be laminated with steel (e.g., thin-walled steel) or plastic (e.g., plastic pipe).

Binders for powder metallurgy are known in the art. (See, e.g., U.S. Pat. Nos. 6,008,281; 7,074,254; and 7,384,446, which are incorporated by reference herein in their entireties). Preferred binders as contemplated herein may include, but are not limited to, epoxy powder (e.g. Scotchkote® Brand Fusion Bonded Epoxy Powder such as 226N+ epoxy powder, available from 3M Corporation) and thermosetting epoxy resin (e.g., Scotchcast 265 thermosetting epoxy resin, also available from 3M Corporation). Suitable binders may include polyurethane resin or polyester resin. Thermosetting resins are known in the art. (See, e.g., U.S. Pat. No. 5,739,184, which is incorporated by reference herein in its entirety.) Other suitable binders include waxes and polymeric binders. (See, e.g., U.S. Pat. No. 6,048,379, which is incorporated by reference herein in its entirety).

The perforator guns as disclosed herein for use in perforator devices may include metal or steel. For example, the shaped components or perforators may be formed from a mixture that comprises barite, carbon fiber, steel (e.g., Ancorsteel 1000 or 1000B brand powdered steel available from Hoeganese Corporation), and a binder.

FIG. 1 shows an example of a perforator gun 10 for use in an oil and gas well. The perforator gun 10 is a closed tube having a plurality of apertures shaped and sized to contain a cased explosive charge 12. A detonating cord (not shown) may be positioned inside the gun 10. The particular size and shape of the exemplary perforator gun 10 and its components can vary greatly, as known in the art. It should be recognized that the concepts of the invention claimed herein are not limited to the particular structures shown in FIG. 1.

In use, the perforator gun 10 is lowered into a well. When the gun 10 is at the correct depth in the well, the cased explosive charges 12 are ignited via the detonating cord (not shown). Explosion of the charge forms a jet, which is propelled outward through the side of the gun 10, through the fluid between the gun 10 and the well casing, through the well casing, and finally into the oil-bearing or natural-gas bearing rock. The resulting holes in the well casing allow oil or natural gas to flow into the well and to the surface.

Figure 2:
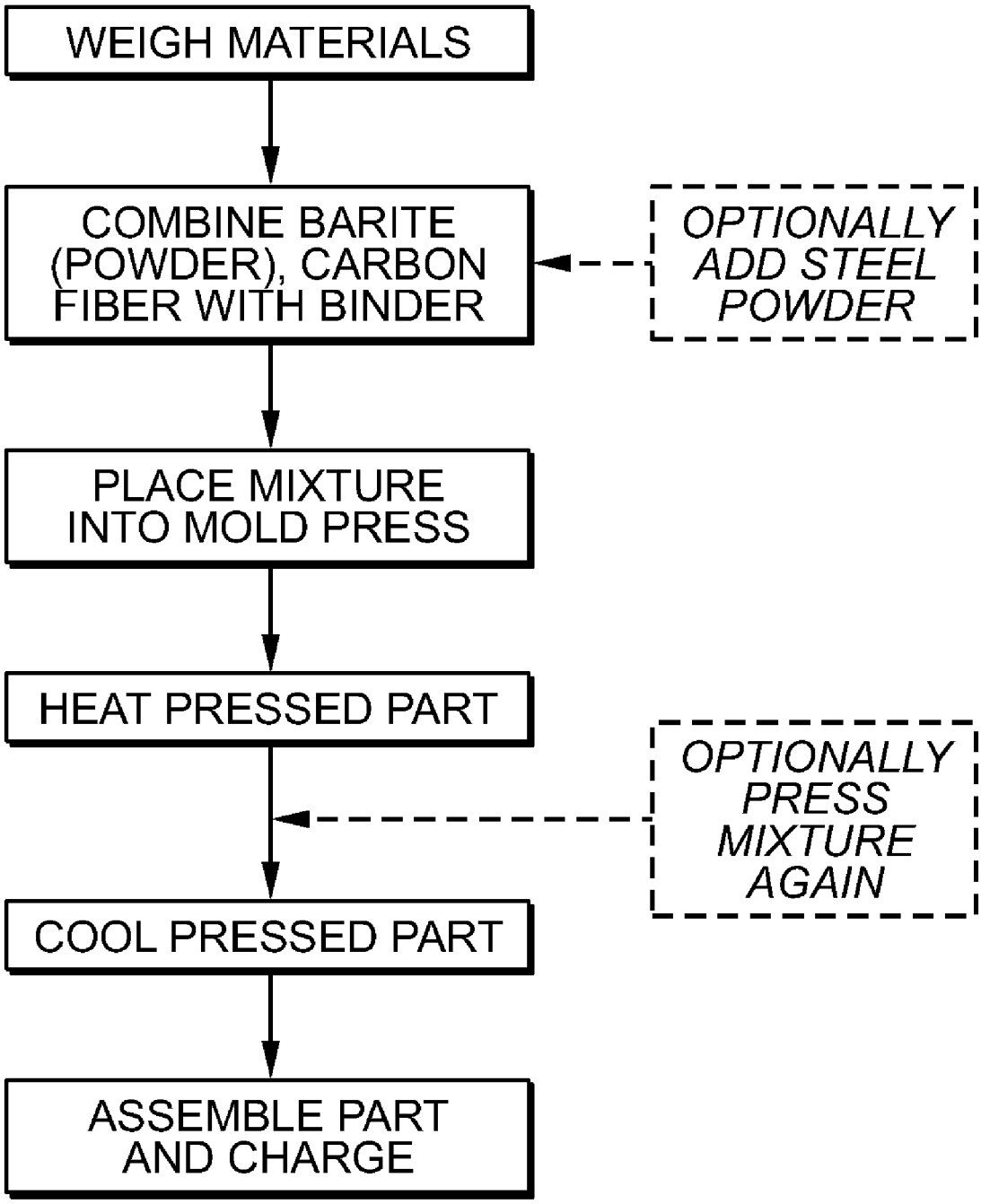
FIG. 2 is a flow chart showing one example of a method of making a perforating gun.

Referring to FIG. 2, compositions comprising barite, carbon fiber, a binder, and optionally steel powder may be combined to form a mixture. The mixture may then be pressed in a mold to provide a green form of a case or liner part. Subsequently, the part is heated to a sufficient temperature to cure the binder (e.g., to a temperature of about 300-400° F.). Optionally, the heated part may be pressed again in the same mold or a different mold. The heated part then may be rapidly cooled.

Figure 3:
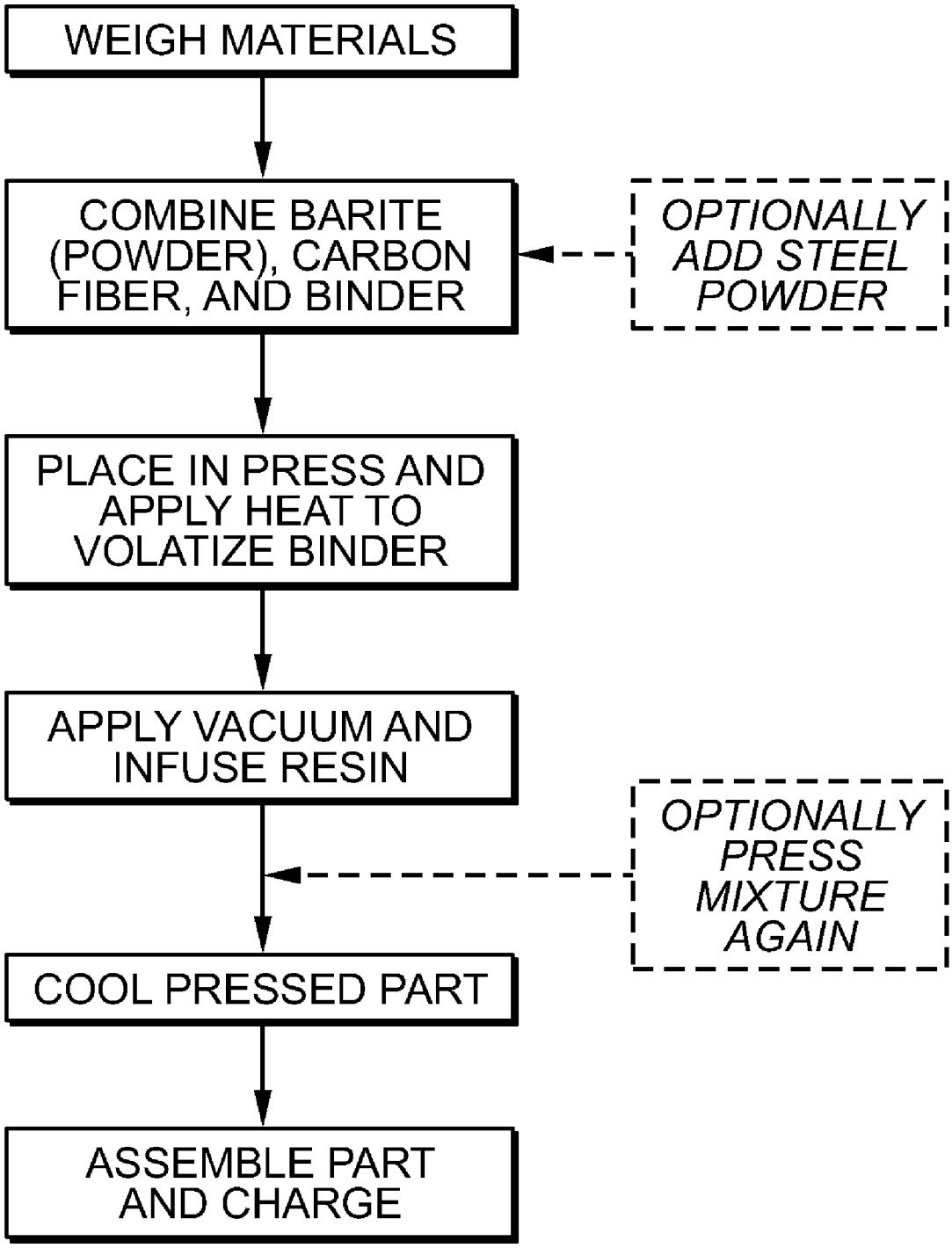
FIG. 3 is a flow chart showing another example of a method of making a perforating gun.

Referring to FIG. 3, compositions comprising barite, carbon fiber, and a binder (e.g., wax or a polymeric binder) may be prepared and pressed into the shape of a perforator gun in a mechanical or hydraulic press. Heat may then be applied to the shaped perforator gun which is sufficient to volatize the binder and create a porous barite matrix. A vacuum is applied to the perforator gun, at which point resin is infused into the perforator gun and allowed to cure. The resin infuses into the porous barite matrix, forming a hard, resilient, and machinable perforator gun. In other embodiments, barite can be formed into a ceramic paste or matrix which is molded into shape, processed, and heated in the same manner as ceramics (e.g., porcelain parts, bearings, and utensils). Optionally, the heated part may be pressed again in the same mold or a different mold. The heated part then may be rapidly cooled and subsequently assembled.

In the foregoing description, certain terms have been used for brevity, clearness, and understanding. No unnecessary limitations are to be implied therefrom beyond the requirement of the prior art because such terms are used for descriptive purposes only and are intended to be broadly construed. The different apparatuses and method steps described herein may be used alone or in combination with other apparatuses and method steps. It is to be expected that various equivalents, alternatives and modifications are possible within the scope of the appended claims.

What is claimed is:

1. A perforating device for generating one or more perforations through a well casing, the perforating device comprising:

a tubular perforating gun;

shaped charges;

apertures of the perforating gun configured to hold one or more shaped charges, wherein the tubular perforating gun comprises a mixture of barite and carbon fibers.

2. The perforating device according to claim I, wherein the mixture further comprises steel.

3. The perforating device according to claim 1, wherein the mixture further comprises a binder.

4. The perforating device according to claim 3, wherein the binder is a cured epoxy powder.

5. The perforating device according to claim 4, wherein the binder is a curable thermoset epoxy resin.

6. The perforating device according to claim 5, wherein the resin is a thermoset epoxy resin.

7. The perforating device according to claim 4, wherein the binder is a polymeric material.

8. The perforating device according to claim 4, wherein the binder is a wax.

9. The perforating device according to claim 4, wherein the binder is flash-cured.

10. The perforating device according to claim 4, wherein the binder is sintered.

11. The perforating device according to claim 1, wherein the mixture further comprises barite having a density of about 3.0-7.5 grams/cc.

12. A method of making a perforating device for generating one or more perforations through a well, the method comprising forming a tubular perforating gun out of a mixture comprising barite and carbon fibers, said tubular perforating gun having apertures formed therein configured to hold one or more shaped charges.

13. The method of claim 12, wherein the mixture further comprises steel.

14. The method of claim 12, wherein the mixture has a density in the range of 3.0-7.5 grams/cc.

15. The method of claim 12, wherein the mixture further comprises a binder.

16. The method of claim 12, wherein forming comprises the step of pressing the mixture into a forming mold to form the perforating gun.

17. The method of claim 16, wherein forming further comprises the step of heating the mold to a temperature of about 300-400° F. in the mold.

18. The method of claim 17, wherein forming further comprises the step of cooling the mold to room temperature.

* * * * *